US009482036B2

(12) United States Patent
Linden et al.

(10) Patent No.: US 9,482,036 B2
(45) Date of Patent: Nov. 1, 2016

(54) SELF-DRAINING KEYED CYLINDER INTEGRATED INTO DOOR TRIM

(71) Applicant: Ford Global Technologies, LLC, Dearborn, MI (US)

(72) Inventors: Howard Paul Tsvi Linden, Oak Park, MI (US); Jerry P. Bonnici, Macomb, MI (US); James Edward Wooten, Sterling Heights, MI (US); Rajesh K. Patel, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/207,770

(22) Filed: Mar. 13, 2014

(65) Prior Publication Data

US 2015/0259953 A1 Sep. 17, 2015

(51) Int. Cl.

| | |
|---|---|
| ***E05B 85/06*** | (2014.01) |
| ***E05B 77/34*** | (2014.01) |
| ***E05B 17/18*** | (2006.01) |
| ***E05B 81/90*** | (2014.01) |

(52) U.S. Cl.

CPC ..... *E05B 85/06* (2013.01); *E05B 17/181* (2013.01); *E05B 77/34* (2013.01); *E05B 81/90* (2013.01); *Y10T 70/5155* (2015.04)

(58) Field of Classification Search

CPC ..... E05B 9/084; E05B 85/00; E05B 85/02; E05B 77/34; E05B 17/14; E05B 79/04; E05B 85/08; E05B 17/181; E05B 17/18; E05B 17/186; E05B 85/06; E05B 81/90; Y10T 70/5155

USPC ..... 70/336, 344, 348, 350, 352, 357, 490, 70/491, 492, 372, 373, 375, 423, 427, 455, 70/454, 237

See application file for complete search history.

(56) References Cited

U.S. PATENT DOCUMENTS

| | | | | |
|---|---|---|---|---|
| 2,747,397 A * | 5/1956 | Jacobi | ..... | 70/455 |
| 3,122,013 A * | 2/1964 | Jacobi | ..... | 70/455 |
| 3,898,824 A * | 8/1975 | Borlinghaus | ..... | 70/455 |
| 4,006,616 A * | 2/1977 | Rubner et al. | ..... | 70/455 |
| 4,041,301 A | 8/1977 | Pelchat | | |

(Continued)

FOREIGN PATENT DOCUMENTS

| | | |
|---|---|---|
| JP | 200515375 A | 6/2005 |
| JP | 2005193827 A | 7/2005 |
| WO | 2011000909 A1 | 1/2011 |

*Primary Examiner* — Christopher Boswell
*Assistant Examiner* — Amanda L Miller
(74) *Attorney, Agent, or Firm* — Jason C. Rogers; Price Heneveld LLP

(57) ABSTRACT

A vehicle door includes an outer panel and an inner frame defining a cavity, wherein a portion of the outer panel defines a generally downward outer surface. A trim member is attached to the outer surface, wherein the trim member and the outer surface define a cylinder receptacle in communication with the cavity. A keyed cylinder is disposed within the cylinder receptacle, wherein a longitudinal axis of the keyed cylinder is substantially normal to the outer surface, and the keyed cylinder slopes downward toward an outward surface of the trim member. The vehicle door also includes an internal locking mechanism and a key aperture of the keyed cylinder, wherein the internal locking mechanism includes a drain channel that slopes toward the key aperture and the cylinder receptacle, and wherein the drain channel is positioned parallel with the longitudinal axis of the keyed cylinder.

18 Claims, 7 Drawing Sheets

(56) References Cited

U.S. PATENT DOCUMENTS

| | | | | | |
|---|---|---|---|---|---|
| 4,349,722 | A | * | 9/1982 | Kurth et al. | 219/202 |
| 4,423,611 | A | * | 1/1984 | Neyret et al. | 70/455 |
| 4,594,866 | A | * | 6/1986 | Neyret | 70/455 |
| 4,939,916 | A | * | 7/1990 | Gruenewald et al. | 70/373 |
| 4,998,953 | A | * | 3/1991 | Wilkin | 70/452 |
| 5,297,405 | A | * | 3/1994 | Manning et al. | 70/208 |
| 5,467,624 | A | * | 11/1995 | Myers | 70/455 |
| 5,640,864 | A | * | 6/1997 | Miyamoto | 70/379 R |
| 5,697,238 | A | * | 12/1997 | Oike | 70/373 |
| 5,709,453 | A | | 1/1998 | Krent et al. | |
| 6,696,652 | B1 | * | 2/2004 | Spies | 200/61.62 |
| 8,146,393 | B2 | * | 4/2012 | Katagiri et al. | 70/208 |
| 2013/0145804 | A1 | * | 6/2013 | Yamakage et al. | 70/492 |
| 2014/0096576 | A1 | * | 4/2014 | Zimmer | 70/101 |

* cited by examiner

SELF-DRAINING KEYED CYLINDER INTEGRATED INTO DOOR TRIM

FIELD OF THE INVENTION

The present invention generally relates to keyed cylinders for vehicle doors, and more specifically, keyed cylinders for vehicle doors with self-draining structures.

BACKGROUND OF THE INVENTION

For many conventional vehicles, the locking mechanism for vehicle doors is typically controlled by a wireless device that can remotely operate the locking mechanism for the vehicle door. A keyed cylinder may be used as a back-up mechanism for unlocking a vehicle door in situations where the remote device is not working. Typically, the keyed cylinder is located proximate the door handle for the vehicle door. In certain instances, the opening of a keyed cylinder can be concealed by a cover or cap.

SUMMARY OF THE INVENTION

According to one aspect of the present invention, a vehicle door includes an outer panel and an inner frame defining a cavity, wherein a portion of the outer panel defines a downwardly-oriented outer surface. A trim member is attached to the downwardly-oriented outer surface, wherein the trim member and the downwardly-oriented outer surface define a cylinder receptacle in communication with the cavity. A keyed cylinder is disposed within the cylinder receptacle, wherein a longitudinal axis of the keyed cylinder is substantially normal to the downwardly-oriented outer surface, and the keyed cylinder slopes downward toward an outward surface of the trim member. The vehicle door also includes an internal locking mechanism and a key aperture of the keyed cylinder, wherein the key aperture is in communication with the internal locking mechanism and the cylinder receptacle and the internal locking mechanism includes a drain channel that slopes toward the key aperture and the cylinder receptacle, and wherein the drain channel is positioned parallel with the longitudinal axis of the keyed cylinder.

According to another aspect of the present invention, a vehicle door includes an outer panel including a generally convex outer surface defining a cylinder receptacle and a keyed cylinder disposed within the cylinder receptacle and proximate a lower portion of the convex outer surface. A longitudinal axis of the keyed cylinder is positioned substantially normal to the lower portion, and the keyed cylinder slopes downward toward the outer panel.

According to another aspect of the present invention, a vehicle door includes an outer panel and an inner frame defining a cavity. A downwardly-angled outer surface of the outer panel defines a cylinder receptacle in communication with the cavity and a keyed cylinder is disposed within the cylinder receptacle. A longitudinal axis of the keyed cylinder is substantially normal to the downwardly angled outer surface and the keyed cylinder slopes downward toward the outer panel.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
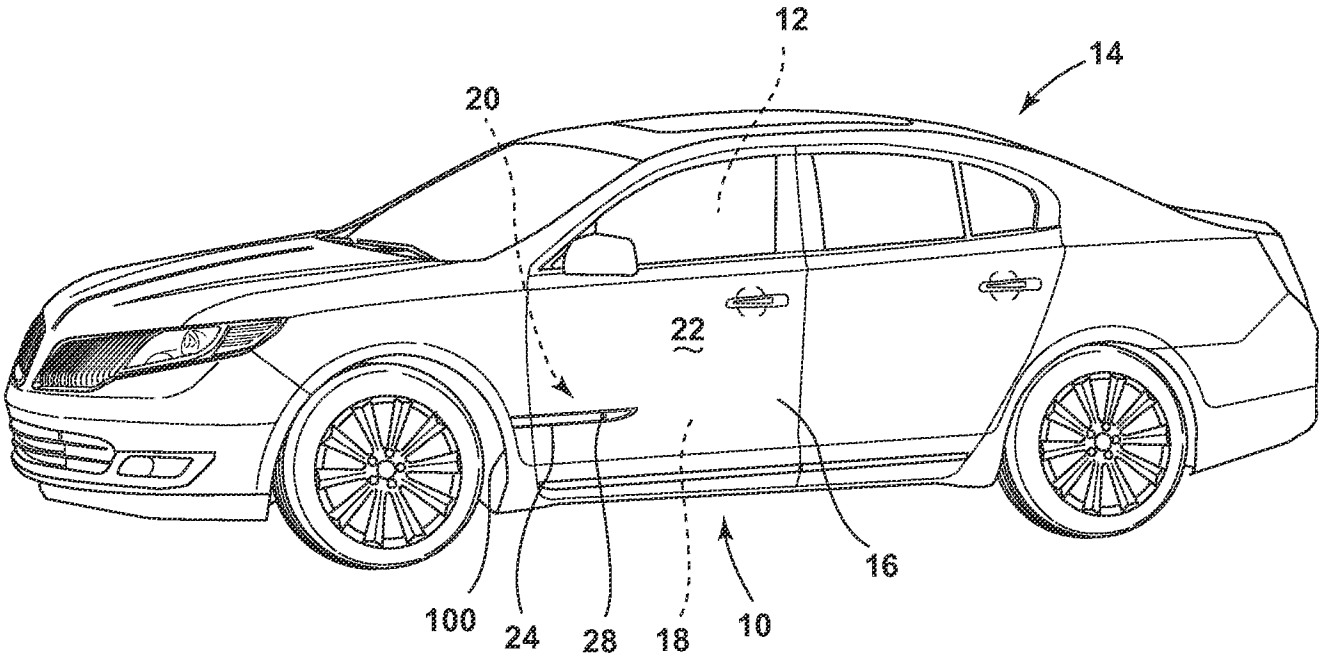
FIG. 1 is a side perspective view of a vehicle with an embodiment of the self-draining keyed cylinder installed within the vehicle door.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
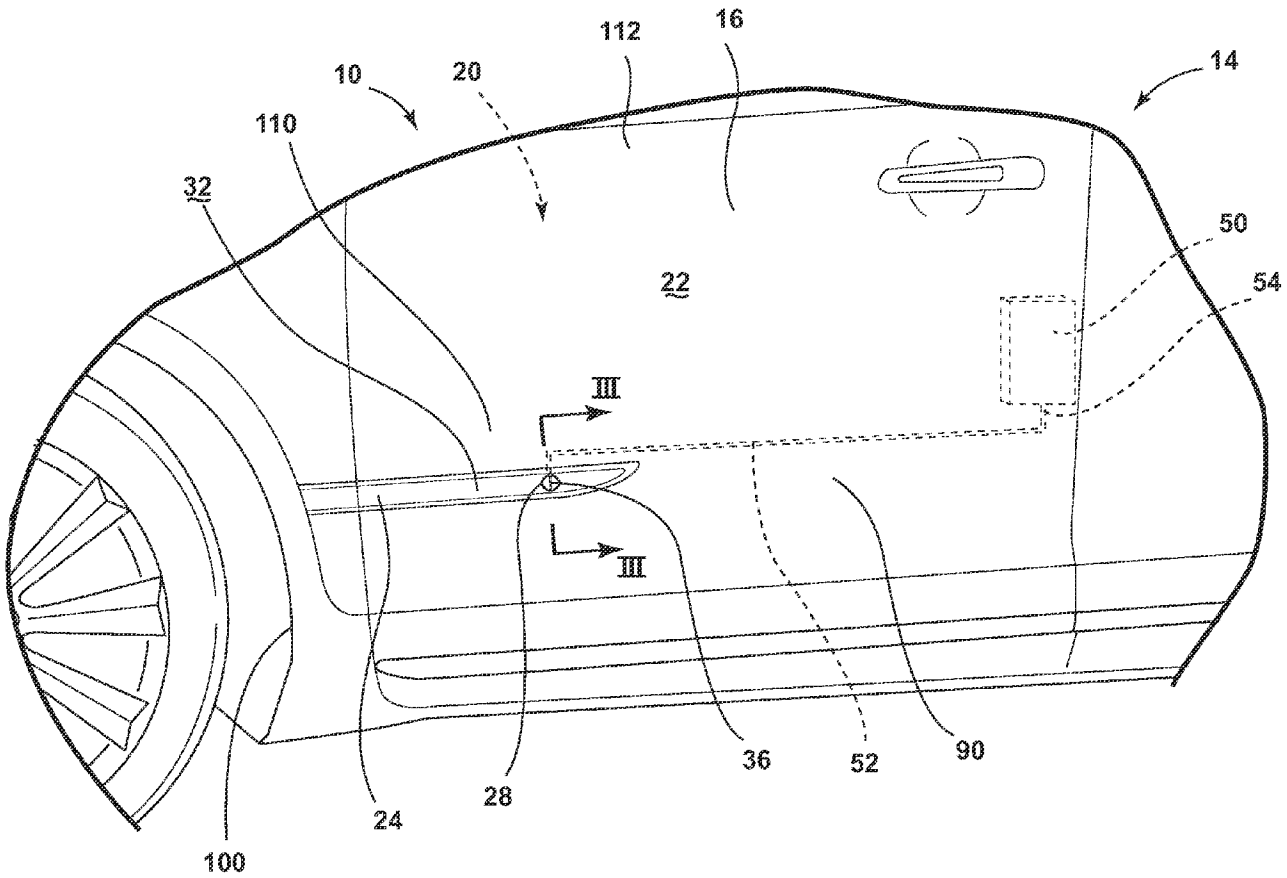
FIG. 2 is a detail side perspective view of the vehicle door of FIG. 1.
Figure 3:
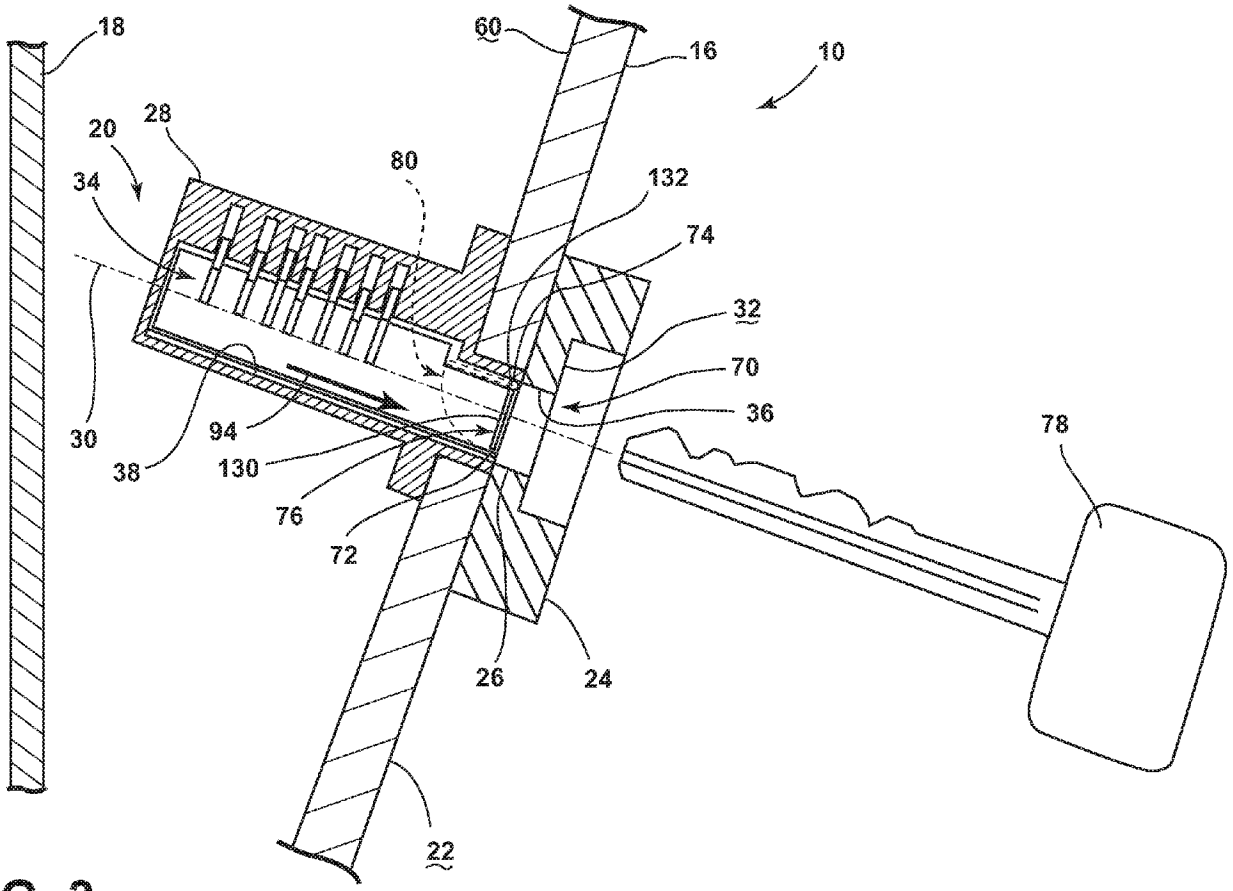
FIG. 3 is a cross-sectional view of the self-draining keyed cylinder of FIG. 2, taken at line III-III.
Figure 4:
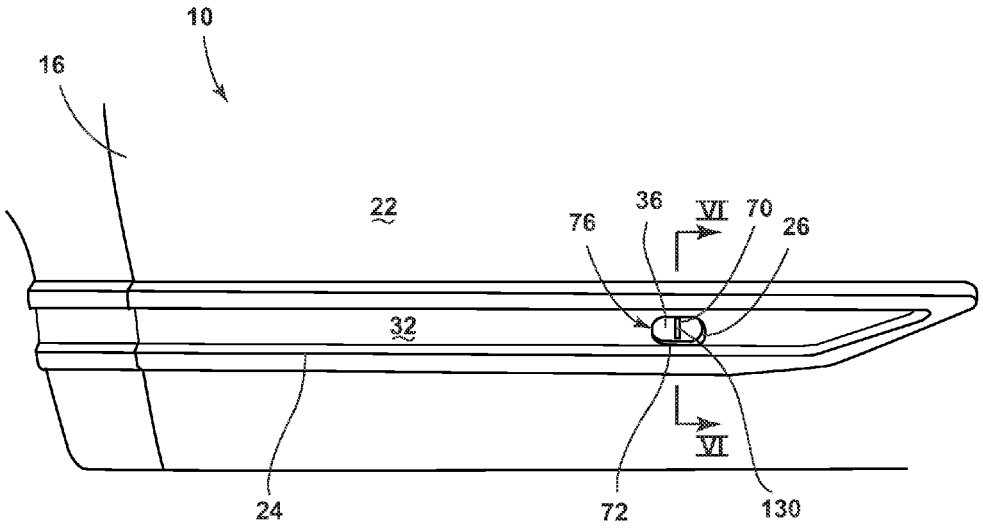
FIG. 4 is a perspective view of an alternate embodiment of the self-draining keyed cylinder.
Figure 5:
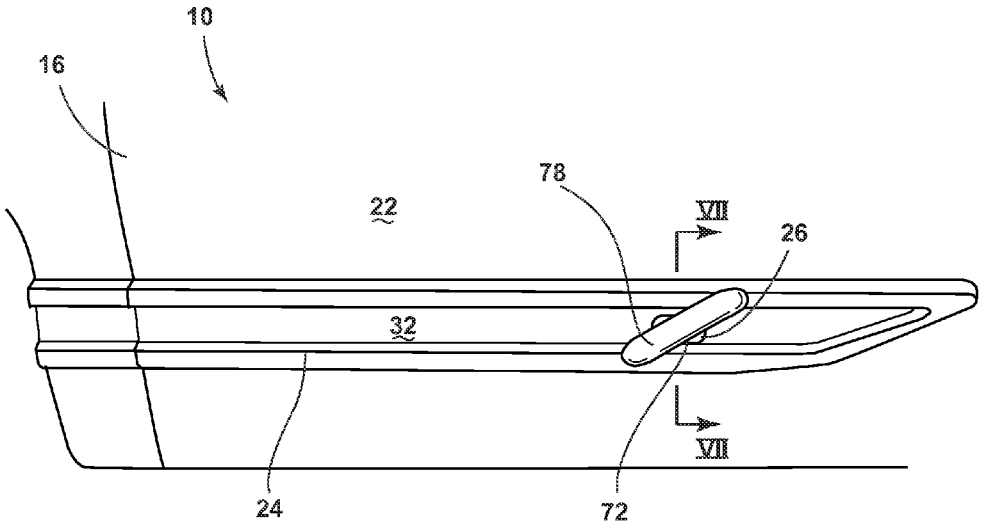
FIG. 5 is a detail perspective view of the self-draining keyed cylinder of FIG. 4 with the key installed within the self-draining keyed cylinder.
Figure 6:
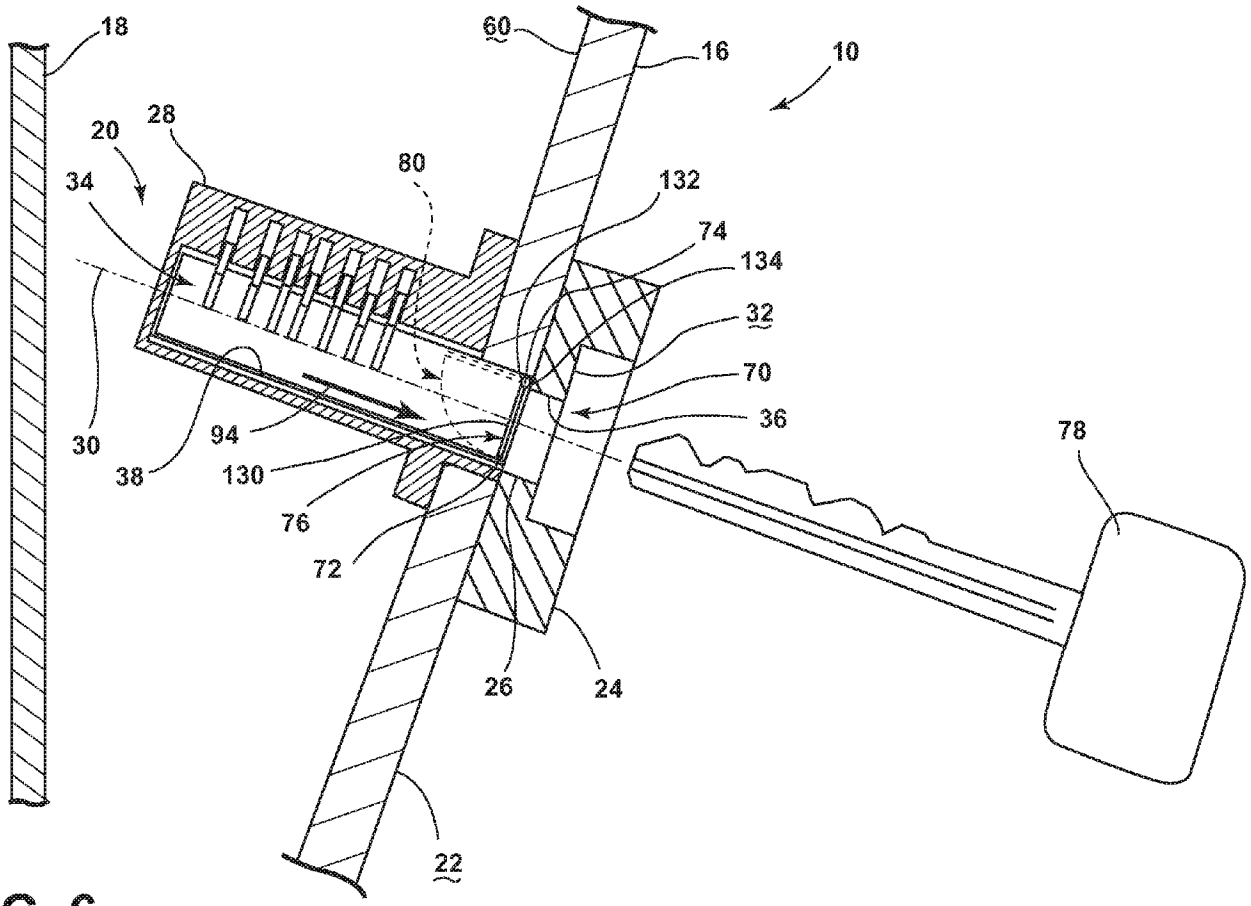
FIG. 6 is a cross-sectional view of the keyed cylinder of FIG. 4 with the operable aperture in a closed position.
Figure 7:
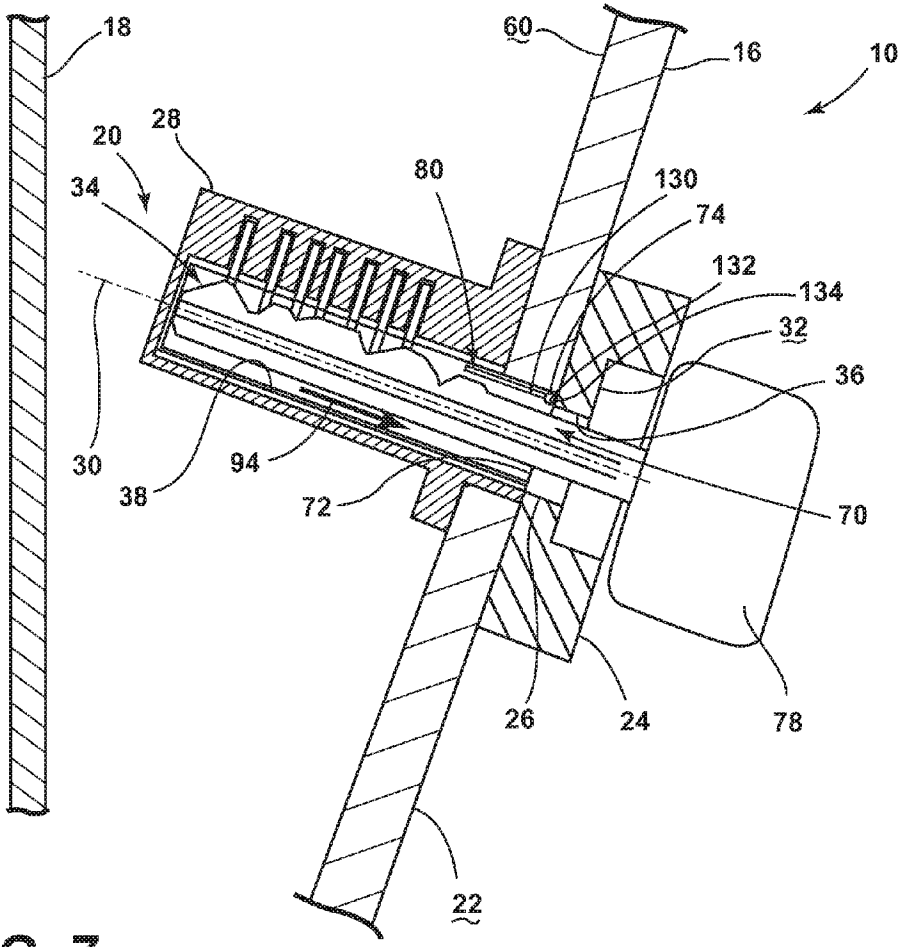
FIG. 7 is a cross-sectional view of the self-draining keyed cylinder of FIG. 5 with the key installed and the operable aperture in an open position.
Figure 8:
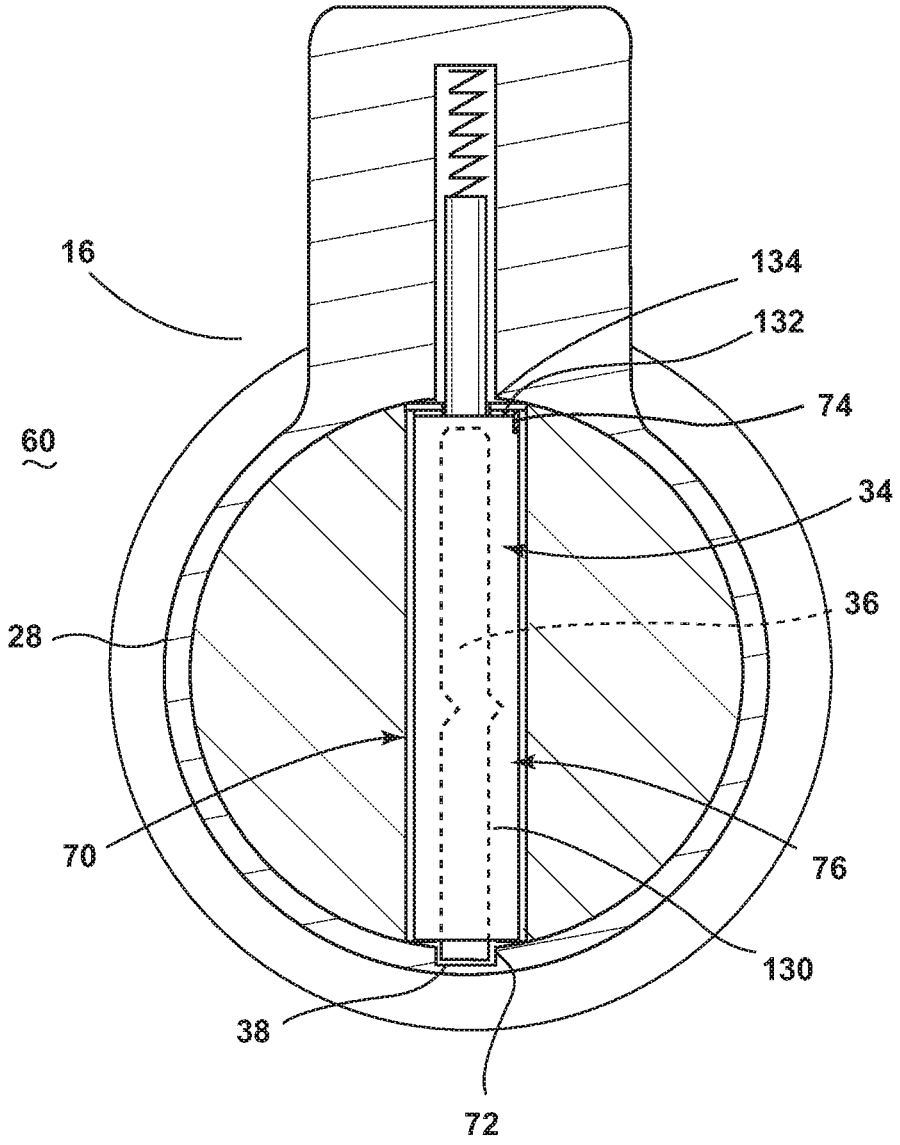
FIG. 8 is a detail cross-sectional view of the self-draining keyed cylinder of FIG. 6 taken at line VIII-VIII.

As shown in FIGS. 1-3, reference numeral 10 generally refers to a vehicle door for accessing a passenger cabin of a vehicle, according to one embodiment. The vehicle door 10 includes an outer panel 16 and an inner frame 18 that define a cavity 20, wherein the outer panel 16 defines a downwardly-oriented outer surface 22. A trim member 24 is attached to the downwardly-oriented outer surface 22, wherein the trim member 24 and the downwardly-oriented outer surface 22 define a cylinder receptacle 26 in communication with the cavity 20. A keyed cylinder 28 is disposed within the cylinder receptacle 26, wherein a longitudinal axis 30 of the keyed cylinder 28 is substantially normal to the downwardly-oriented outer surface 22. The keyed cylinder 28 is configured to slope downward toward an outward surface 32 of the trim member 24. An internal locking mechanism 34 and a key aperture 36 are included within a keyed cylinder 28, wherein the key aperture 36 is in communication with the internal locking mechanism 34 and the cylinder receptacle 26. The internal locking mechanism 34 includes a drain channel 38 that slopes toward the key aperture 36 and the cylinder receptacle 26, wherein the drain channel 38 is positioned parallel with the longitudinal axis 30 of the keyed cylinder 28.

Referring again to FIG. 2, the keyed cylinder 28 is in communication with the locking device 50 of the vehicle door 10. In various embodiments, a rod 52 or other member can extend from the keyed cylinder 28 to a lock switch 54 of the locking device 50. In this manner, the activation of the keyed cylinder 28 activates the locking device 50 of the vehicle door 10 to lock or unlock the vehicle door 10.

Referring again to FIG. 3, when installed within the vehicle door 10, the keyed cylinder 28 is coupled to either the interior surface 60 of the outer panel 16 or a portion of the inner frame 18, or both. The key aperture 36 is positioned within the cylinder receptacle 26 and is substantially flush with or set slightly behind the portion of the trim member 24 proximate the cylinder receptacle 26. It is contemplated that the majority of the keyed cylinder 28 is installed within the cavity 20 of the vehicle door 10, such that substantially all of the internal locking mechanism 34 is positioned within the cavity 20. In various embodiments, a portion of the keyed cylinder 28 can extend outward through the cylinder receptacle 26, such that at least a portion of the keyed cylinder 28 is disposed outside of the cavity 20. In such an embodiment, the keyed cylinder 28 can include an outer trim piece that surrounds the portion of the keyed cylinder 28 positioned outside of the cavity 20. In various alternate embodiments, the trim member 24 of the outer panel 16 can act as the outer trim piece to conceal various portions of the keyed cylinder 28 that are disposed outside of the cavity 20.

Referring now to FIGS. 3-7, the keyed cylinder 28 can include an operable aperture 70 disposed within the key aperture 36, wherein the operable aperture 70 includes a drain opening 72 in communication with the drain channel 38. The operable aperture 70 includes a biasing mechanism 74 that biases the operable aperture 70 toward a closed position 76. A matching key 78 is adapted for insertion through the key aperture 36, wherein the matching key 78, during insertion, biases the operable aperture 70 toward an open position 80. In this manner, the matching key 78 is configured to engage and operate the internal locking mechanism 34. It is contemplated that the drain opening 72 is in communication with the drain channel 38 in both the open and closed positions 80, 76 of the operable aperture 70.

Referring again to FIGS. 1-3, the outer panel 16 of the vehicle door 10 can include a generally convex downwardly-oriented outer surface 22, within which the cylinder receptacle 26 is defined. In such an embodiment, the cylinder receptacle 26 can be disposed within a lower portion 90 of the convex downwardly-oriented outer surface 22 of the outer panel 16. In this manner, when the keyed cylinder 28 is disposed within the cylinder receptacle 26, the longitudinal axis 30 of the keyed cylinder 28, being positioned substantially normal to the lower portion 90 of the convex downwardly-oriented outer surface 22, slopes generally downward toward the outer panel 16. It is also contemplated that the outer panel 16 can include a downwardly angled surface within which the cylinder receptacle 26 is defined.

Referring again to FIGS. 3, 6 and 7, the cylinder receptacle 26 is disposed within a portion of the outer panel 16 that faces in a generally downward direction, below level. With the keyed cylinders 28 disposed in this generally downward configuration, foreign material 94 such as water, other fluids, debris and other materials that may become disposed within an inner portion of the internal locking mechanism 34 can, through the force of gravity, be funneled down the drain channel 38, and through the key aperture 36, to the exterior of the vehicle.

Referring now to FIGS. 1-5, the keyed cylinder 28 can be disposed within a trim member 24, wherein the trim member 24 is positioned proximate a tire well 100 of the vehicle 14. The positioning of the keyed cylinder 28 within the trim member 24 serves to camouflage the keyed cylinder 28 such that the appearance of the keyed cylinder 28 and the operable aperture 70 is minimal. To further camouflage the appearance of the keyed cylinder 28, an outward surface 32 of the trim member 24 that defines the key aperture 36, the key aperture 36 and the operable aperture 70 and at least a portion of the keyed cylinder 28 proximate the cylinder receptacle 26 can include the same exterior color and/or finish. In various embodiments, the keyed cylinder 28 can be disposed within a portion of the outer panel 16 outside of the trim member 24. In such embodiments, the key aperture 36, the operable aperture 70, and the outer panel 16 can include a similar exterior finish to camouflage the appearance of the keyed cylinder 28. The positioning of the keyed cylinder 28 within the trim member 24, in addition to camouflaging the keyed cylinder 28, also provides the user of the vehicle 14 with an indication as to the location of the keyed cylinder 28, in case the matching key 78 is necessary to unlock the vehicle door 10. The trim member 24 within which the keyed cylinder 28 is disposed can be an elongated trim piece, a vehicle logo, or other trim piece that can be used to conceal the location of the keyed cylinder 28. Generally, the location of the trim member 24, as discussed above, will be in a lower portion 90 of the outer panel 16, such that when the keyed cylinder 28 is positioned substantially flush with the downwardly-oriented outer surface 22 of the outer panel 16, or the outward surface 32 of the trim member 24, the keyed cylinder 28 can be positioned to maintain the generally downward configuration of the longitudinal axis 30 of the keyed cylinder 28.

In various embodiments, the keyed cylinder 28 can be positioned in a middle or upper portion 110, 112 of the outer panel 16. In such embodiments, in order to maintain the downward slope of the keyed cylinder 28, the keyed cylinder 28 can be mounted at an angle, or can be mounted within a trim member 24 that includes a downwardly-oriented outer surface 22 within the trim member 24. In this manner, the keyed cylinder 28 can be disposed in a middle or upper portion 110, 112 of the outer panel 16, be flush-mounted, and also maintain the generally downward slope of the keyed cylinder 28.

In various embodiments, it is contemplated that the trim member 24 within which the keyed cylinder 28 is disposed may not be parallel with the outer panel 16 of the vehicle door 10. This non-parallel configuration can be used to dispose the keyed cylinder 28 flush with the trim member 24 and maintain the downward angle in portions of the outer panel 16 that are facing a generally upward or level angle, or where a greater downward angle of the keyed cylinder 28 is desired than that of the surrounding portion of the outer panel 16.

Referring again to FIGS. 1-5, in various embodiments where the keyed cylinder 28 is disposed within a trim member 24 positioned proximate the tire well 100, foreign materials 94 including fluid and debris, from the front tires can be projected onto the trim member 24 and over the keyed cylinder 28, wherein portions of the fluid and debris can be forced within the operable aperture 70 and into the internal locking mechanism 34. Foreign material 94 can become disposed within the keyed cylinder 28 and the internal locking mechanism 34 as a result of general operation of the vehicle 14, car washes, precipitation that falls upon the vehicle 14 and in other similar situations where foreign material 94 is in contact with the keyed cylinder 28. It is contemplated that the operable aperture 70 can include one or more operable members that are biased toward the closed position 76 of the operable aperture 70. It is further contemplated that the operable member of the operable aperture 70 can be oriented either vertically, horizontally, or at some other angle. The orientation of the operable members can be determined by the configuration of the trim member 24, the location of the keyed cylinder 28 within the outer panel 16 and the trim member 24 or other similar aesthetic and functional factors. In the various configurations where the drain channel 38 of the internal locking mechanism 34 cooperates with the drain opening 72 of the operable aperture 70, it is contemplated that the operable aperture 70 can be disposed within the operable member of the operable aperture 70.

Referring now to FIGS. 3 and 6-8, the operable member can be one or more pivotally operable panels 130 that are biased in a closed position 76 substantially parallel with the outer panel 16 of the vehicle door 10. In such an embodiment, the insertion of the matching key 78 swings or rotates the one or more pivotally operable panels 130 about a hinge 132 to an open position 80. It is contemplated that the drain opening 72 can be defined by a small gap or loose fitting engagement of the operable panel 130 with the key aperture 36. This gap is configured to allow foreign material 94 to pass out of the keyed cylinder 28 and to the exterior of vehicle 14. It is also contemplated that the operable aperture 70 can include operable members that include, but are not limited to, rotating members, accordion-type members, spring-loaded members, other outwardly biased members, or sliding members that are configured to substantially close off the internal locking mechanism 34 while not in use.

In various embodiments, in order to minimize the amount of foreign material 94 that enters into the internal locking mechanism 34, the drain opening 72 can include a weep material that is configured to substantially fill the drain opening 72, while also allowing foreign material 94 to flow through the weep material in the drain opening 72 and through the key aperture 36 to the exterior of the vehicle 14. The weep material can include various porous materials that can include, but are not limited to, rope, fiberglass, porous foam, and other porous materials that can allow fluid to flow therethrough.

Referring again to FIGS. 6 and 7, the operable aperture 70 can be disposed within a portion of the trim member 24 attached to the downwardly-oriented outer surface 22 of the outer panel 16. A recess 134 disposed within the trim member 24 is configured to house the biasing mechanism 74 for the operable aperture 70 and are also configured to receive the operable panels 130 or members of the operable aperture 70 when moved to the open position 80, as a result of the insertion of the key within the operable aperture 70. In this manner, the operable aperture 70 can be offset behind the outward surface 32 of the trim member 24. It is contemplated that the operable aperture 70 can be configured to rotate with portions of the keyed cylinder 28 as the matching key 78 is inserted therein and rotated in order to operate the internal locking mechanism 34. Accordingly, in such embodiments, the movement of the operable aperture 70 is minimized to move just wide enough to allow entry of the matching key 78.

As illustrated in FIG. 3, it is further contemplated that the operable aperture 70 can be a part of the keyed cylinder 28 that is completely disposed therein and installed during manufacture of the keyed cylinder 28 and the internal locking mechanism 34. It is also contemplated that the trim member 24 can include a separate operable aperture 70 that includes the drain opening 72 through which fluid disposed within the internal locking mechanism 34 can flow outward via the drain channel 38.

In various embodiments, the cylinder receptacle 26 and the keyed cylinder 28 can be positioned in various portions of the vehicle door 10, including, but not limited to, forward portions of the door 10, rearward portions of the door 10, upper or lower portions of the door 10, center of the door 10, and other similar positions. It is further contemplated that the one or more vehicle doors 10, including doors for entering the cabin 12 of vehicle 14, trunk doors, and other operable doors and hatches within the vehicle 14, can include a cylinder receptacle 26 and keyed cylinder 28, as described above. Within each of these doors 10, the keyed cylinder 28 described above can act as a back-up mechanism for accessing various portions of the vehicle 14 when the primary mechanism is not working. In the various embodiments, the primary mechanism can include, but is not limited to, wireless remote, keypad interface, finger or other biometric interface, and others.

In the various embodiments, the various portions of the outer panel 16, the trim member 24 and the keyed cylinder 28 can be made of various substantially rigid materials that can include, but are not limited to, aluminum, aluminum alloys, steel, composite materials, plastic, combinations thereof, and other substantially rigid materials that can be used proximate exterior portions of a vehicle 14. It is further contemplated that the materials used for the keyed cylinder 28 in the trim member 24 are substantially corrosion resistant to resist the effects of various materials such as liquid, salt, and other substances experienced during operation of a vehicle 14.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door comprising:

an outer panel and an inner frame defining a cavity, wherein a portion of the outer panel defines a downwardly-oriented outer surface;

a trim member attached to the downwardly-oriented outer surface, wherein the trim member and the downwardly-oriented outer surface define a cylinder receptacle in communication with the cavity;

a keyed cylinder disposed within the cylinder receptacle, wherein a longitudinal axis of the keyed cylinder is substantially normal to the downwardly-oriented outer surface, wherein the keyed cylinder slopes downward toward an outward surface of the trim member;

an internal locking mechanism and a key aperture of the keyed cylinder, wherein the key aperture is in communication with the internal locking mechanism and the cylinder receptacle, wherein the internal locking mechanism includes a drain channel that slopes downward toward the key aperture and the cylinder receptacle, and wherein the drain channel is positioned entirely within the keyed cylinder and parallel with the longitudinal axis of the keyed cylinder, and wherein the drain channel is co-axial with and co-extensive with a portion of the key aperture;

an operable panel disposed within the key aperture and a drain opening formed between the key aperture and operable panel and in communication with the drain channel, wherein the operable panel is biased toward a closed position; and a matching key adapted for insertion through the key aperture and adapted to bias the operable panel toward an open position, wherein the matching key is configured to engage and operate the internal locking mechanism, wherein the drain opening allows passage of fluid through the drain channel and the key aperture in both the open and closed positions.

2. The vehicle door of claim 1, wherein the keyed cylinder is coupled to at least one of an interior surface of the outer panel and the inner frame, and wherein the key aperture is positioned within the cylinder receptacle and substantially flush with a portion of the trim member proximate the cylinder receptacle.

3. The vehicle door of claim 1, wherein the outward surface of the trim member, the key aperture and the operable panel include the same exterior finish, and wherein a wicking material is disposed within the drain channel proximate the key aperture.

4. A vehicle door comprising:

an outer panel including a generally convex outer surface defining a cylinder receptacle;

a keyed cylinder within the cylinder receptacle proximate a lower portion of the convex outer surface, wherein a longitudinal axis of the keyed cylinder is substantially normal to the lower portion, and wherein a drain channel defined within the keyed cylinder slopes downward toward the outer panel and defines a co-axial key aperture of the keyed cylinder;

an operable panel disposed within the key aperture and a drain opening formed between the key aperture and operable panel and in communication with the drain channel, wherein the operable panel is biased toward a closed position; and a matching key adapted for insertion through the key aperture that biases the operable panel toward an open position, wherein the matching key is configured to engage and operate the internal locking mechanism, wherein the drain opening is in communication with the drain channel in both the open and closed positions.

5. The vehicle door of claim 4, wherein the keyed cylinder includes an internal locking mechanism, the key aperture being in communication with the internal locking mechanism and the cylinder receptacle, wherein the internal locking mechanism includes the drain channel that slopes downward toward the key aperture and the cylinder receptacle, and wherein the drain channel is positioned parallel with the longitudinal axis of the keyed cylinder.

6. The vehicle door of claim 5, wherein the keyed cylinder is coupled to an interior surface of the outer panel, and wherein the key aperture is positioned within the cylinder receptacle and is substantially flush with the convex outer surface proximate the cylinder receptacle.

7. The vehicle door of claim 5, wherein the keyed cylinder is coupled at least partially to an inner frame of the vehicle door.

8. The vehicle door of claim 5, further comprising:

a trim member attached to the convex outer surface proximate the cylinder receptacle, wherein the cylinder receptacle is further defined by the trim member, and wherein the key aperture is positioned within the cylinder receptacle and substantially flush with an outward surface of the trim member.

9. The vehicle door of claim 6, wherein the outward surface of the trim member is parallel with the convex outer surface of the outer panel.

10. The vehicle door of claim 6, wherein at least a portion of the keyed cylinder proximate the cylinder receptacle includes substantially the same color as the door panel color.

11. The vehicle door of claim 6, wherein at least a portion of the keyed cylinder proximate the cylinder receptacle includes substantially the same color as the outward surface of the trim member.

12. A vehicle door comprising:

an outer panel;

a downwardly-angled outer surface of the outer panel defining a cylinder receptacle;

a keyed cylinder disposed within the cylinder receptacle, wherein a longitudinal axis of the keyed cylinder is substantially normal to the downwardly-angled outer surface;

a drain channel entirely defined by the keyed cylinder that slopes downward along the longitudinal axis toward the outer panel and through a key aperture of the keyed cylinder;

an operable panel disposed within the key aperture and a drain opening formed between the key aperture and operable panel and in communication with the drain channel, wherein the operable panel is biased toward a closed position; and a matching key adapted for insertion through the key aperture that biases the operable panel toward an open position, wherein the matching key is configured to engage and operate the internal locking mechanism, wherein the drain opening is in communication with the drain channel in both the open and closed positions.

13. The vehicle door of claim 12, wherein the keyed cylinder includes an internal locking mechanism, wherein the key aperture is in communication with the internal locking mechanism and the cylinder receptacle, wherein the internal locking mechanism includes the drain channel that slopes downward toward the key aperture and the cylinder receptacle.

14. The vehicle door of claim 13, wherein the keyed cylinder is coupled to an interior surface of the outer panel, and wherein the key aperture is positioned within the cylinder receptacle and is substantially flush with the convex outer surface proximate the cylinder receptacle.

15. The vehicle door of claim 13, wherein the keyed cylinder is coupled at least partially to an inner frame of the vehicle door.

16. The vehicle door of claim 13, further comprising:

a trim member attached to the convex outer surface proximate the cylinder receptacle, wherein the cylinder receptacle is further defined by the trim member, and wherein the key aperture is positioned within the cylinder receptacle and is substantially flush with an outward surface of the trim member.

17. The vehicle door of claim 16, wherein the outward surface of the trim member is parallel with the downwardly-angled outer surface of the outer panel.

18. The vehicle door of claim 12, wherein the outward surface of the trim member, the key aperture and the operable panel include the same exterior finish.

* * * * *